US005141056A

United States Patent [19]

Tailby

[11] Patent Number: 5,141,056

[45] Date of Patent: Aug. 25, 1992

[54] INJECTION VALVE FOR INJECTING CHEMICALS AND SIMILAR LIQUID SUBSTANCES INTO SUBSURFACE FORMATIONS

[75] Inventor: Roger Tailby, Algård, Norway

[73] Assignee: Den Norske Stats Oljeselskap A.S, Stavanger, Norway

[21] Appl. No.: 689,513

[22] Filed: Apr. 23, 1991

[51] Int. Cl.[5] ..... E21B 34/10; E21B 34/14

[52] U.S. Cl. ..... 166/318; 166/237; 166/321; 166/322; 166/323

[58] Field of Search ..... 166/318, 321, 322, 323, 166/325, 332, 237, 238, 166, 169

[56] References Cited

U.S. PATENT DOCUMENTS

| | | | |
|---|---|---|---|
| 3,007,524 | 11/1961 | Pistole et al. | 166/322 X |
| 3,051,243 | 8/1962 | Grimmer et al. | 166/224 |
| 4,399,871 | 8/1983 | Adkins et al. | 166/325 |
| 4,441,558 | 4/1984 | Welch et al. | 166/317 |
| 4,494,608 | 1/1985 | Williams et al. | 166/317 |
| 4,552,218 | 11/1985 | Ross et al. | 166/319 |
| 4,766,960 | 8/1988 | Williamson, Jr. | 166/321 |

FOREIGN PATENT DOCUMENTS

| | | | |
|---|---|---|---|
| 2079822 | 1/1982 | United Kingdom | 166/321 |

*Primary Examiner*—Hoang C. Dang

*Attorney, Agent, or Firm*—Foley & Lardner

[57] ABSTRACT

Injection valve for injecting chemicals into subsurface formations penetrated by an oil or gas well, comprising a cylindrical housing (10) with seals (24A, 24B) for cooperation with well tubing (100), said housing enclosing a cylindrical chamber (1) in which a piston-like sleeve (2) is movable axially so as to cover or uncover one or more radial ports (10A) through a cylindrical wall of said housing (10). A spring (3) normally urge the sleeve (2) to a position in which the ports (10A) are covered. A collet (4) is mounted for axial displacement in a chamber extension (1A) beyond an inner end of the sleeve (2), a compression spring (5) urging the collet against said inner end of the sleeve (2). A device (40) is provided for displacing the collet (4) to an inner end position in the chamber extension (1A) and for activating locking mechanism (4F, 9) for locking the collet (4) in the inner end position, whereby an increased pressure within the chamber (1) is able to move the sleeve (2) so as to uncover the ports (10A) for an injection operation.

11 Claims, 2 Drawing Sheets

INJECTION VALVE FOR INJECTING CHEMICALS AND SIMILAR LIQUID SUBSTANCES INTO SUBSURFACE FORMATIONS

BACKGROUND OF THE INVENTION

This invention relates to an valve for injection injecting chemicals and similar liquid substances into sub-surface formations being penetrated by an oil or gas well. Such wells are commonly provided with a casing and tubing means enabling operation of tools for downhole operations. The running and installation of a chemical injection valve may occasionally be desirable in order to inject fluids into a formation, for example a scale inhibitor at the outset of water breakthrough. The chemical injection valve is then installed in the appropriate sliding sleeve door or tubing port, thereby replacing for example a so-called concentric standing valve.

In many practical situations a chemical injection valve according to the present invention may be used in an arrangement as described for example in U.S. Pat. No. 4,441,558, FIGS. 1 and 2 of which illustrate somewhat schematically known principles of downhole operations by means of a pumpdown toolstring. This US patent, however, is directed to a particular dual valve being an improvement and replacement of the formerly well known ball-type check valve.

Reference is also made to U.S. Pat. No. 3,051,243 which describes a form of flow-control device which may perform the function of a sliding sleeve door as referred to above.

In a simultaneous and copending patent application, Ser. No. 07/689,547, the present applicants are also describing novel and specific toolstring methods and equipment which advantageously can be employed when running and installing the present injection valve. Thus, the chemical injection valve is well suited for installation and operation within a horizontal or highly-deviated well without, however, being restricted to such use.

OBJECTS AND SUMMARY OF THE INVENTION

It is an object of the present invention to provide a chemical injection valve of comparatively simple design and nevertheless being very reliable and secure in practical operations.

In analogy with other valves for downhole operation in a production tubing, the present chemical injection valve comprises a cylindrical housing with seals for co-operation with the surrounding tubing the housing encloses a cylindrical chamber in which a piston-like sleeve is movable in an axial direction, so as to cover or uncover one or more radial ports through a cylindrical wall of said housing. Spring means normally urge the sleeve to a position in which the port or ports is (are) covered.

During running of such an injection valve, and before an installed valve is ready for the intended chemical injection operation, it is important that the sleeve is securely restrained in a closed position covering the radial ports. An increased pressure applied from the surface through the tubing is then intended to move the sleeve within the chamber so as to uncover the ports for an injection operation.

The novel and specific features of the injection valve according to the invention, providing an advantageous solution in connection with the above, are stated in the claims.

BRIEF DESCRIPTION OF THE DRAWINGS

Further specific features and advantages of this invention will be apparent from the following detailed description of an exemplary embodiment as illustrated in the drawings, of which.

DETAILED DESCRIPTION OF THE PREFERRED EMBODIMENTS

Figure 1B:
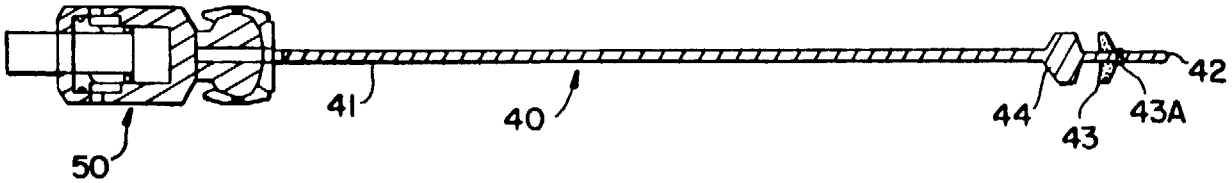
FIG. 1B shows an activating rod element to be considered as an essential component of the chemical injection valve, and shown at approximately the same scale as the arrangement of FIG. 1A.
Figure 1A:
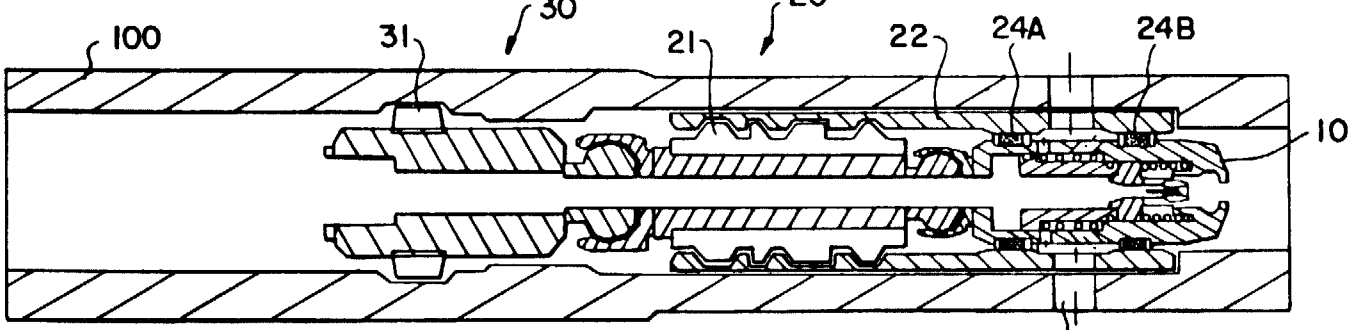
FIG. 1A schematical illustrate an axial section through an installation of a chemical injection valve together with a shifter unit and a lock unit within a tubing section including a sliding sleeve and a sleeve door or port unit.

In FIG. 1A a section of tubing 100 is illustrated at a point where ports 20A have been formed in order to receive fluids from a corresponding production zone in the well. Thus, in cooperation with ports 20A there is provided a sliding sleeve 22 being operated by a shifter mandrel or unit 20 having conventional keys 21 mating with grooves in sliding sleeve 22. Further, according to common practice there is a lock unit positioned in tubing section 100 by means of dogs 31 projecting into corresponding recesses in the interior circumference of tubing 100. Conventional universal couplings interconnect lock unit 30 and shifter unit 20 and the latter is correspondingly coupled to an injection valve 10 installed for cooperation with ports 20A. Seals 24A and 24B around the circumference of valve housing 10 serve to connect valve 10 tightly into the sliding sleeve 22 for its intended function.

As will be explained further below with reference in particular to FIGS. 4 and 5, activating means 40 comprising a comparatively long rod element 41 is adapted to be run by means of suitable pumpdown methods through tubing 100 so as to be inserted through the central bore in lock unit 30, shifter unit 20 and into the injection valve 10. The activating rod means 40 should be considered as an integral component of the chemical injection system in which valve housing 10 is a main component. The forward (right) end of rod element 41 in FIG. 1B has a prong or nose member 42 with a first push member 43 behind it, and further behind there is a second push member 44, these members being all adapted to enter into an interior chamber of housing 10 in order to perform their intended functions. At the opposite or trailing end of rod element 41 there is shown a conventional coupling to a circulation valve 50 which may be of known type. Together with such a circulation valve 50 the complete activating rod means or unit 40 may be run by a toolstring when the same or a similar toolstring has installed the units as shown in FIG. 1A.

At this point it should be noted that the length of rod element 41 is sufficient to pass through both units 20 and 30 in FIG. 1A and bring the inner or foremost end members 42, 43, 44 into the interior of valve housing 10 for cooperation therewith.

Figure 2:
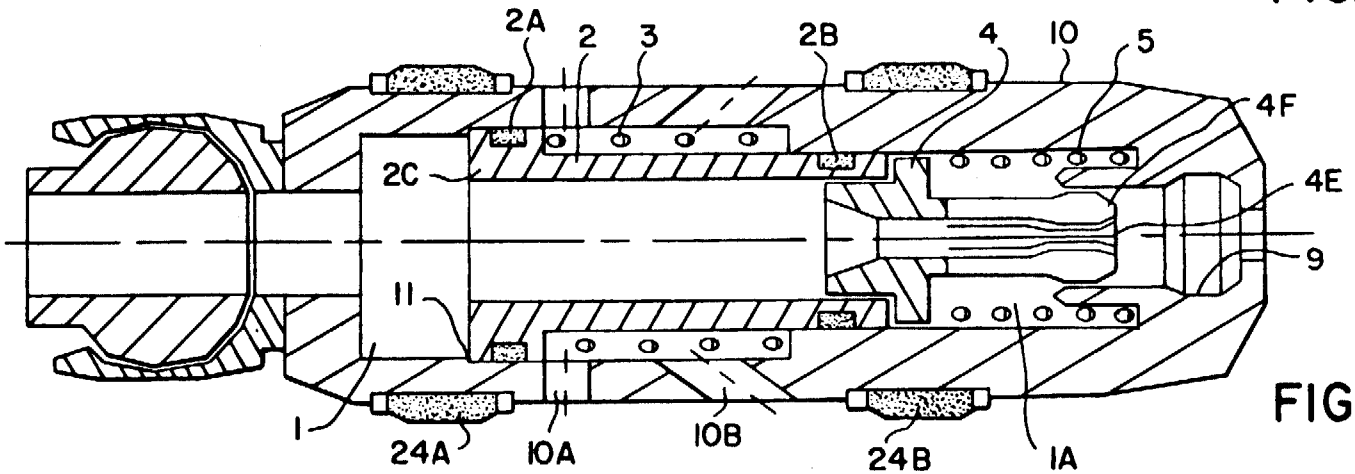
FIG. 2 shows in enlarged axial section an embodiment of the chemical injection valve according to the invention.

Turning now to FIG. 2 the main structure of the injection valve shall be described. As in FIG. 1A valve housing 10, which is of a substantially cylindrical shape, has two exterior seals bidirectional 24A and 24B and an interior cylindrical chamber 1. Through the housing wall there are provided a number of radial ports 10A which are normally closed by a sleeve 2 arranged to be slidable within chamber 1 against the force of a helical spring 3. In the position of sleeve 2 shown in FIG. 2 fluid communication from chamber 1 through ports 10A is blocked. Note in this connection seal 2A at the left or outer end of sleeve 2. An abutment or step 11 in the interior cylindrical surface defining chamber 1 serves to position sleeve 2 in its normal or rest position as shown in FIG. 2. The inner or right hand end portion of sleeve 2 protrudes into a chamber extension IA having preferably a reduced diameter in relation to the main chamber 1. At this inner end of sleeve 2 there is another seal 2B.

A slide or collet 4 provided in the chamber extension IA performs an important function in the chemical injection valve. Collet 4 may be displaced axially in chamber extension IA against a compression spring 5 and is formed with a projecting reduced diameter inner end portion which is split into expandable fingers 4F, the purpose of which is to be described further below. The collet 4 has an axial bore 4E extending also centrally through the finger portion 4F. At the opposite or outer end facing sleeve 2, the bore 4E has a widened opening in order to facilitate the inserting of the prong member 42 at the forward end of activating means 40 shown in FIG. 1B. The surrounding part of collet 4 has a reduced diameter for protruding into sleeve 2.

Figure 3:
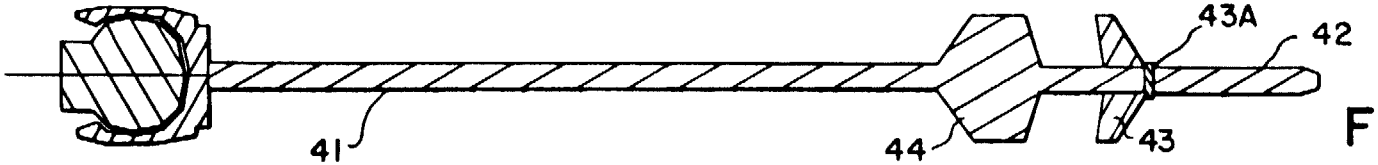
FIG. 3 shows the rod element of FIG. 1B in somewhat greater detail.

Activating means 40 in FIG. 1B is shown at an enlarged scale in FIG. 3 primarily in order to illustrate better the details at the forward or inner end of the rod element 41. Thus, it will be seen that nose or prong member 42 has a somewhat pointed end portion and has a slightly increased diameter in relation to the adjacent rod length running rearwardly to the second push or stop member 44. The first push member 43 is releasably attached to the innermost portion of this rod length by means of a shear pin 43A. In other words, when this shear pin is broken, member 43 may slide along the reduced diameter rod length between member 44 and the increased diameter prong member 42.

From the above it will be understood that this chemical injection valve is a normally closed valve. The radial ports 10A through the cylindrical walls or housing 10 are covered by the spring loaded sleeve 2, and this sleeve is itself backed by the spring loaded collet 4. The combination of the two springs 3 and 5 serves to hold the sleeve 2 closed against normal tubing pressure during installation of the valve and also during retrieval of the toolstring in which the valve is incorporated.

Figure 4:
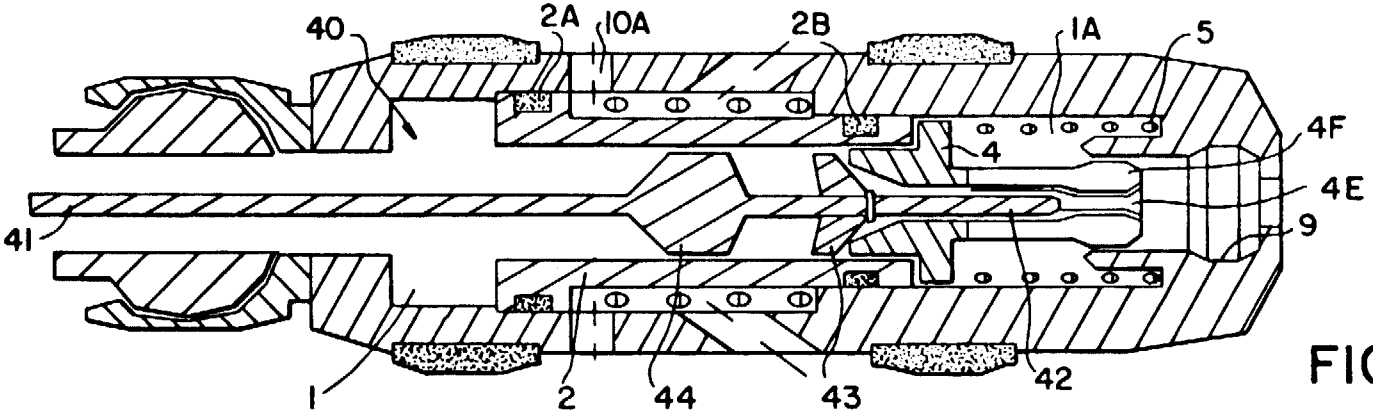
FIG. 4 shows the rod of FIG. 3 element partially inserted into the chemical injection valve.

A first step during activation of this valve is illustrated in FIG. 4, where rod element 41 is inserted so that the forward members 42,, 43 and 44 thereof have entered into the interior of valve housing 10, i.e., both the main chamber 1 and the chamber extension IA. More specifically, the first push member 43 is seen to be just engaging the outer end of collet 4, whereas the prong member 42 has penetrated far into, but not quite through, the collet bore 4E. It is to be noted that the lateral dimensions of both push members 43 and 44 are just somewhat smaller than the interior diameter of sleeve 2, so as to be guided therein.

When the rod element 41 is pushed from the position shown in FIG. 4 further inwards (to the right), collet 4 will also be moved inwards during compression of spring 5 until collet 4 reaches the bottom of the chamber extension IA. In this bottom position, finger projections 4F will be positioned opposite an annular recess 9 in the end wall of housing 10.

Upon continued application of a push force through rod element 41, shear pin 43A will break and the first push member 43 will be released so as to permit further movement of rod element 41 and its prong member or tip 42 into a narrowed end portion of bore 4E at the level of finger projections 4F, so that these will be expanded into the recess 9.

Figure 5:
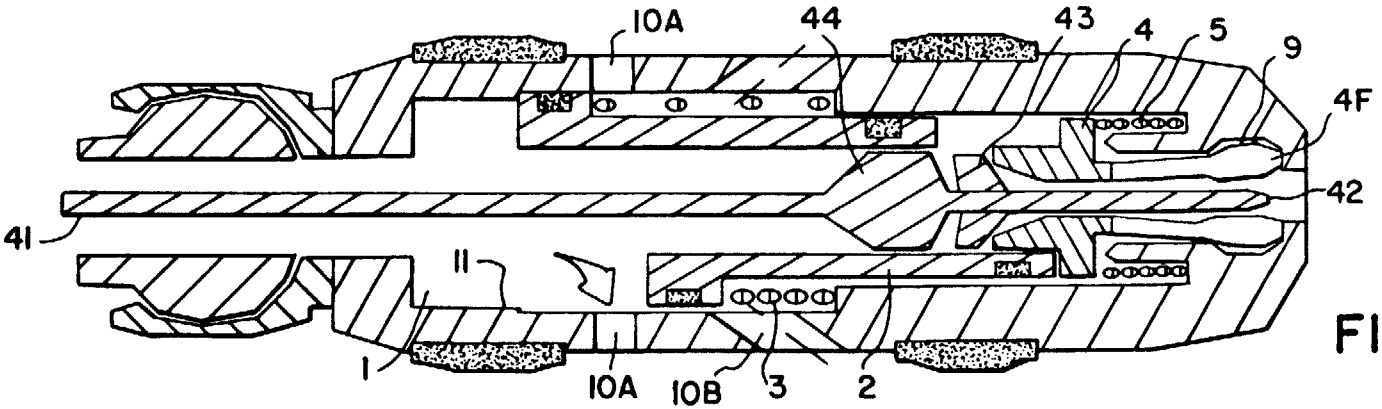
FIG. 5 shows the rod element of FIG. 3 completely inserted into the valve, thereby making possible injection of chemicals through the valve.

This is the position illustrated in FIG. 5, in which the second push member has a position just behind the first push member 43, the latter having moved relatively backwards along the rod length between prong member 42 and the second push member 44. In moving its bottom position, collet 4 has compressed spring 5 substantially completely. The second push member 44 serves mainly to limit the inward movement of rod element 41 so as to bring finger projections 4F into the correct position with respect to recess 9.

During activation of the injection valve by means of rod element 41 with its functional members 42, 43 and 44, sleeve 2 maintains its position as shown in the upper half of FIG. 5 (as well as in FIGS. 2 and 4). A pressure increase applied through the toolstring will then be able to move sleeve 2 from the closed position to an open position uncovering port 10A as shown in the lower part of FIG. 5. Spring 3 is then compressed.

Referring again to FIG. 1B, circulation valve 50 will also be opened during this operation and the chemical to be injected is circulated down to the injection valve and out of the valve through ports 10A. The chemical or fluid to be injected is thereby allowed to enter into the surrounding formation. After injection of the required quantity of fluid, release of pumping pressure at the surface will allow the sleeve 2 to be retracted under the influence of spring 3, and ports 10A are again closed.

Reversed circulation through the tubing will serve to pull the activating rod element 41 out of the chemical injection valve, and the collet 4 therein will return to its normal position backing up the sleeve 2, as shown in FIG. 2. Further applications of pressure will then not be able to open the injection valve.

After retrieval of the rod element 41, the injection valve 10 is itself retrieved and the sliding sleeve door (20, FIG. 1A) is closed. Production units such as a concentric standing valve may then be installed immediately, or other intervals or zones in the well may be produced while the chemical injected is allowed to soak for days or weeks. Installation of a concentric standing valve is necessary before production backflow may commence.

As shown in FIGS. 2, 4 and 5 the chemical injection valve housing 10 is provided with high volume ports 10B in addition to radial ports 10A for the chemical injection flow. These additional ports 10B are very useful in the event that spring 3, which is comparatively weak, is not able to return sleeve 2 to its closed position by itself.

When the chemical injection valve is installed downhole as described above, it may still be possible to maintain production from well intervals above the point at which the valve is installed, but production from lower intervals will be restricted because of the comparatively small inner diameter of such a chemical injection valve.

Reverting again to the rod or prong element, generally denoted 40 in FIG. 1B, this component of the chemical injection system can be run and actuated by a toolstring method as described in the applicant's copending patent application No. 07/689,547 (Sak 18 - Coiled Tubing). Rod element 41 in practice may consist of a titanium rod being long enough to reach down through the lock unit 30, the shifter mandrel 20 and to the bottom of the chemical injection valve 10 (see FIG. 1A). The rod element should also be sufficiently flexible to be able to traverse a pipe bend of 1.5 m radius without permanent deformation. As shown in FIG. 1B the top or trailing end of the rod element 41 has a swivel socket for connection to a swivel ball on a circulation valve 50. At the opposite end of rod element 41, the smooth nose or prong 42 is shaped for entering into the collet 4 of the injection valve and more particularly for cooperation with the fingers 4F at the innermost end of this collet.

I claim:

1. An injection valve for allowing the injection of liquid substances into subsurface formations by a well having a casing and tubing means, provided in said casing, for allowing the passage of tools for downhole operations, said tubing means having an access port formed therein which allows access to said subsurface formations, said injection valve comprising:

(A) a cylindrical housing having a radial port formed therein for fluid communication with said access port of said tubing means;

(B) seals, located on opposite sides of said radial port, for sealing said housing from said tubing means of said well;

(C) a piston-like sleeve having inner and outer ends;

(D) a cylindrical chamber which is surrounded by said cylindrical housing and in which said sleeve is axially movable to cover and uncover said radial port, said chamber having an extension extending beyond said inner end of said sleeve and having an inner end located remote from said inner end of said sleeve and having a locking recess formed therein;

(E) spring means for biasing said sleeve towards a position in which said radial port is covered and for resisting movement of said sleeve but allowing movement of said sleeve under an applied fluid pressure within said chamber;

(F) a collet mounted for axial displacement within said extension of said chamber and having expandable fingers formed thereon for locking said collet in said recess when said collet is displaced to said inner end of said extension of said chamber;

(G) a compression spring which biases said collet against said inner end of said sleeve when said collet is not locked in said recess but which is compressed and does not bias said collet against said inner end of said sleeve when said collet is locked in said recess, wherein, when said collet is not locked in said recess, said compression spring and said spring means hold said sleeve in a position in which said radial port is covered by said sleeve with said compression spring and said spring means applying a biasing force against said sleeve which is sufficient to prevent uncovering of said radial port under any reasonable applied fluid pressure in said chamber; and (H) activating means for displacing said collet to said inner end of said extension of said chamber and for expanding said expandable fingers to lock said collet in said recess so that said compression spring no longer biases said collet against said inner end of said sleeve, thereby allowing said sleeve to move under the application of said applied fluid pressure in said chamber against said spring means to uncover said radial port during a fluid injection operation.

2. The valve according to claim 1, wherein said activating means comprises a prong member, and wherein said collet has an axial through-bore formed therein which has a widened outer end formed in an outer end of said collet and opening toward said inner end of said sleeve, said through-bore receiving said prong member of said activating means.

3. The valve according to claim 1, wherein said outer end of said collet is insertable into said inner end of said sleeve.

4. The valve as recited in claim 2, wherein said fingers have radial end projections which are received in said recess when said fingers are expanded.

5. The valve as recited in claim 4, wherein said activating means comprises a rod element which has inner and outer ends, which is substantially longer than said housing, and which is provided with said prong member on said inner end, said prong member being adapted to enter into said collet, said rod element including first and second push members, said first push member being releasably mounted to said rod element between said prong member and said second push member, and said second push member being permanently mounted to said rod element between said outer end and said first push member, said first push member being adapted to compress said spring and to be released from its position on said rod element so as to permit further movement of said prong member into said collet bore and thereby expand said fingers, said second push member being adapted to limit the maximum penetration of said prong member into said collet bore.

6. The valve according to claim 5, wherein the lateral dimensions of said first and second push members are somewhat smaller than that of an inner diameter of said sleeve.

7. The valve according to claim 5, wherein said prong member has a portion which is laterally larger than an adjacent portion of said rod element which carries said first push member, so as to entrain said first push member when said rod element is retracted.

8. The valve according to claim 5, further comprising a shifter mandrel and a lock unit which are coupled to said operations, wherein the length of said rod element is sufficiently great to extend through said housing, said mandrel, and said lock unit.

9. The valve according to claim 5, further comprising a circulation valve unit coupled to said rod element.

10. The valve according to claim 5, wherein an auxiliary, high volume port is formed in said housing for assisting in returning said sleeve to a position in which said radial port is covered after said rod element has been retracted.

11. The valve according to claim 1, wherein said seals are bidirectional seals.

* * * * *